US010398225B2

(12) United States Patent
Ciccacci et al.

(10) Patent No.: US 10,398,225 B2
(45) Date of Patent: Sep. 3, 2019

(54) FREELY INSTALLABLE COOKER

(71) Applicant: WHIRLPOOL EMEA S.P.A., Pero (MI) (IT)

(72) Inventors: Sandro Ciccacci, Sassoferrato (IT); Egle Armonaviciute, Cagli (IT); Maurizio Tursini, Fabriano (IT); Micro Palpacelli, Jesi (IT)

(73) Assignee: Whirlpool EMEA S.p.A., Pero (IT)

( * ) Notice: Subject to any disclaimer, the term of this patent is extended or adjusted under 35 U.S.C. 154(b) by 0 days.

(21) Appl. No.: 15/037,726

(22) PCT Filed: Oct. 30, 2014

(86) PCT No.: PCT/IB2014/065709
§ 371 (c)(1),
(2) Date: May 19, 2016

(87) PCT Pub. No.: WO2015/075587
PCT Pub. Date: May 28, 2015

(65) Prior Publication Data

US 2016/0296012 A1 Oct. 13, 2016

(30) Foreign Application Priority Data

Nov. 21, 2013 (IT) ..... PR2013A0094

(51) Int. Cl.
*A47B 77/08* (2006.01)
*F24C 15/30* (2006.01)
*F24C 15/08* (2006.01)

(52) U.S. Cl.
CPC ..... *A47B 77/08* (2013.01); *F24C 15/08* (2013.01); *F24C 15/30* (2013.01)

(58) Field of Classification Search
CPC ..... F24C 15/08; F24C 15/30; A47B 77/08
USPC ..... 99/340, 428, 335, 339, 377; 126/37 R, 126/191, 21 R, 299 R, 339, 213, 214 B, 126/37 B, 214 A, 39 H, 275 E, 92 A, 126/19 R, 39 BA, 24, 37, 216, 332; 312/111, 314, 317, 237, 248, 228, 229,
(Continued)

(56) References Cited

U.S. PATENT DOCUMENTS 1,667,521 A * 4/1928 Alber ..... F24C 11/00 219/452.11
1,885,041 A * 10/1932 Baker ..... F24C 7/06 126/275 E (Continued)

FOREIGN PATENT DOCUMENTS

DE 102005032510 A1 9/2006
DE 202012100009 U1 4/2012

(Continued)

OTHER PUBLICATIONS

Italian Patent Application No. PR2013A000094. Applicant: Indesit Company S.P.A., Italian Search Opinion re: same dated Nov. 21, 2013.

(Continued)

*Primary Examiner* — Dana Ross
*Assistant Examiner* — Ket D Dang
(74) *Attorney, Agent, or Firm* — Price Heneveld LLP

(57) ABSTRACT

Freely installable cooker comprising:
a support structure;
a first cooking module removable, interchangeable and positionable in a first housing of the support structure.

11 Claims, 10 Drawing Sheets

(58) Field of Classification Search
USPC ..... 312/236, 282, 400, 263, 257.1, 108, 312/265.5, 329, 351, 326, 351.3, 351.1, 312/258, 265.1, 265.2, 209, 206; 219/452.13, 457.1, 459.1, 463.1, 485, 219/524, 478, 398, 403, 541, 392, 450.1, 219/444, 445, 446, 447
See application file for complete search history.

(56) References Cited

U.S. PATENT DOCUMENTS

| | | | | | |
|---|---|---|---|---|---|
| 1,948,402 | A * | 2/1934 | Teller | F24C 15/18 | 126/214 A |
| 2,036,523 | A * | 4/1936 | Freemon | A47J 37/00 | 219/452.13 |
| 2,738,411 | A * | 3/1956 | Sandin | F24C 15/30 | 126/213 |
| 3,064,554 | A * | 11/1962 | Lamb | F24C 15/10 | 126/37 B |
| 3,790,750 | A * | 2/1974 | Giannini | F24C 15/106 | 219/404 |
| 5,975,660 | A * | 11/1999 | Tisbo | A47B 47/045 | 312/108 |
| 6,027,192 | A * | 2/2000 | Irace | A47B 47/02 | 312/205 |
| 7,134,673 | B2 * | 11/2006 | Ferraro | A47B 87/0253 | 280/33.991 |
| 8,430,254 | B2 * | 4/2013 | Kunis | A47B 61/00 | 211/189 |
| 2004/0045952 | A1 * | 3/2004 | Rhinehart | F24C 15/101 | 219/452.13 |
| 2006/0049725 | A1 * | 3/2006 | Simon | A47B 77/02 | 312/111 |
| 2010/0093257 | A1 * | 4/2010 | Elliott | A47B 3/06 | 446/478 |
| 2011/0041831 | A1 * | 2/2011 | Dettloff | F24C 3/12 | 126/39 B |

FOREIGN PATENT DOCUMENTS

| | | | |
|---|---|---|---|
| EP | 1245172 | A1 | 10/2002 |
| GB | 2311128 | A | 9/1997 |
| GB | 2346438 | A | 8/2000 |
| WO | 2004062444 | A2 | 7/2004 |
| WO | 2012032460 | A1 | 3/2012 |

OTHER PUBLICATIONS

International Patent Application No. PCTIB2014065709 filed Oct. 30, 2014, Applicant: Indesit Compay S.P.A.; International Publication No. WO2015075587 published May 28, 2015; International Search Report, dated Apr. 23, 2015 re: same, Written Opinion of the ISA.
Italian Patent Application No. PR2013A000095. Applicant: Indesit Company S.P.A., Italian Search Opinion re: same dated Nov. 21, 2013.
International Patent Application No. PCTIB2014065719 filed Oct. 30, 2014, Applicant: Indesit Compay S.P.A.; International Publication No. WO2015075588 published May 28, 2015; International Search Report, dated Apr. 17, 2015 re: same, Written Opinion of the ISA.
Italian Patent Application No. PR2013A000096. Applicant: Indesit Company S.P.A., Italian Search Opinion re: same dated Nov. 21, 2013.
International Patent Application No. PCTIB2014065722 filed Oct. 30, 2014, Applicant: Indesit Compay S.P.A.; International Publication No. WO2015075589 published May 28, 2015; International Search Report, dated Apr. 21, 2015 re: same, Written Opinion of the ISA.

* cited by examiner 874
873

OFF
ON
874

380
27
5
27
38

51
38
5

FREELY INSTALLABLE COOKER

TECHNICAL FIELD

The present invention relates to a freely installable cooker and a method for its realization.

STATE OF THE ART

Freely installable cookers are known wherein various household electrical appliances are assembled in a support structure, each in a specific housing afforded inside said structure. For example, for the realization of a predetermined freely installable cooker, a predetermined cooker hob and a predetermined oven are added to a given structure. A disadvantage of said construction solution is linked to the limited possibility of customizing a specific product. This leads to considerable costs, since numerous assembly lines must be developed to diversify production in order to satisfy the product differences demanded by the market.

AIM OF THE INVENTION

In this context, the technical task underpinning the present invention is to provide a freely installable cooker which allows a high level of customization to be obtained while reducing production costs to a minimum. A further object of the present invention is allowing a user to intervene on a cooker already purchased and adapt it to changed needs.

BRIEF DESCRIPTION OF THE DRAWINGS

The technical task set and the objects specified are substantially attained by a freely installable cooker comprising the technical characteristics as set out in one or more of the accompanying claims.

Further characteristics and advantages of the present invention will become more apparent from the following indicative, and hence non-limiting, description of a preferred, but not exclusive, embodiment of a freely installable cooker as illustrated in the appended drawings, in which.

DETAILED DESCRIPTION OF PREFERRED EMBODIMENTS OF THE INVENTION

Figure 2:
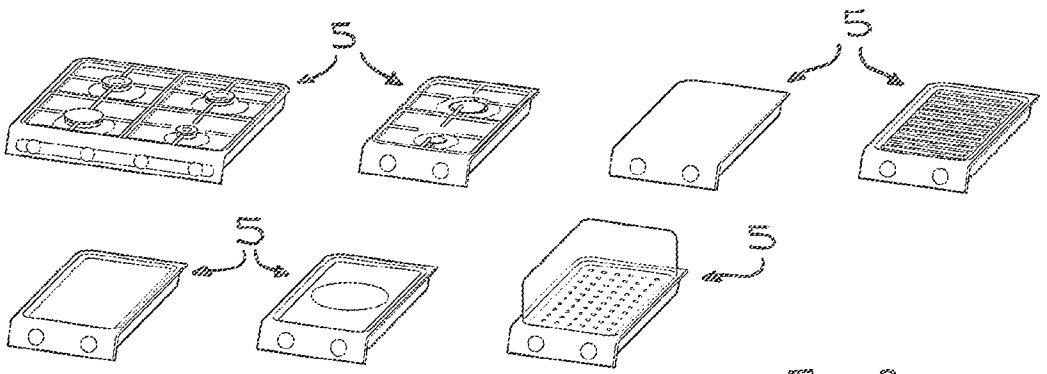
FIGS. 2 and 3 show components to be used on the cooker according to the present invention.

In the accompanying drawings, number 1 indicates a freely installable cooker. "Freely installable cooker" means an independent structure which allows cooking of food products. It is to be considered an alternative to integrated recessed cookers developing continuously on equipped walls. Said freely installable cooker 1 comprises a support structure 2.

The freely installable cooker 1 comprises a first functional module 5. Opportunely, the first functional module 5 is a first cooking module (and therefore used for cooking the food). Said first functional module 5 is removable with respect to the support structure 2. Opportunely, the first cooking module 5 is interchangeable (and replaceable with other functional modules). It is positionable in a first housing 20 of the support structure 2.

Opportunely, the freely installable cooker 1 comprises a resting surface 3 accessible from above.

The freely installable cooker 1 comprises a front wall 31 which extends between the top and the bottom. Typically, the front wall 31 is an opposite wall to a rear wall which is destined to face a wall of the compartment in which the freely installable cooker 1 is positioned.

Figure 8:
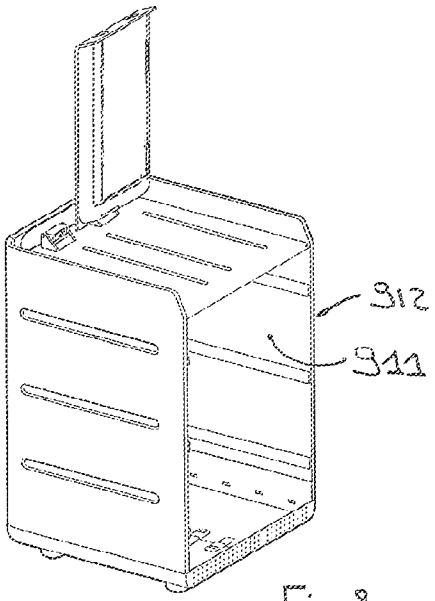
FIGS. 6, 7, 8 show a cooker according to the present invention partially assembled and in different configurations.
Figure 11:
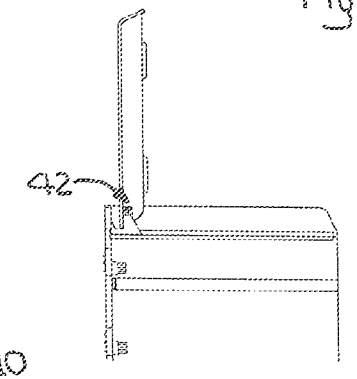
FIGS. 9, 10, 11 show a side view of FIGS. 6, 7, 8.
Figure 7:
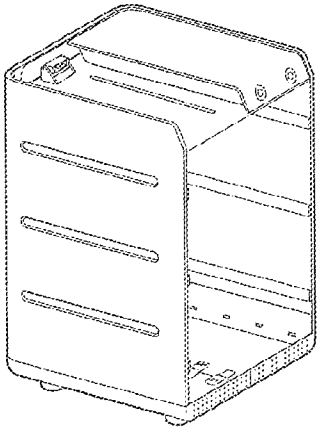
Figure 10:
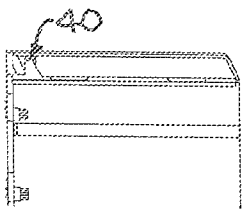
Figure 6:
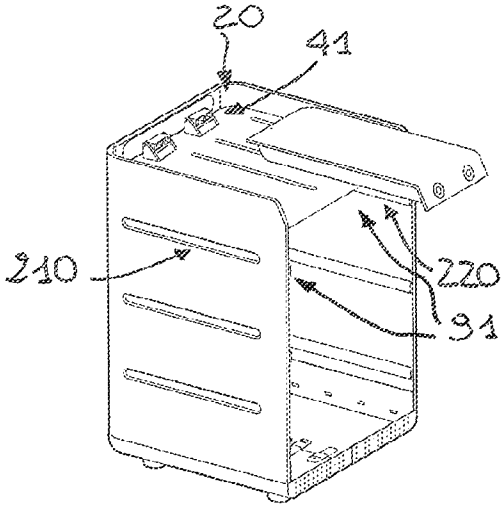
Figure 9:
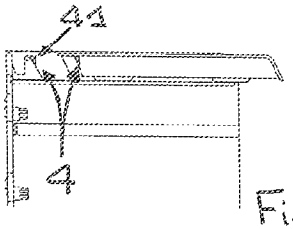

The first housing 20 may be afforded on said resting surface 3. This case occurs especially when the first cooking module 5 is a cooker hob (see for example FIGS. 6, 7, 8). Opportunely, the first cooking module 5 could be an induction, grill, steam cooker hob, Tappan Yaki, or Wok. Opportunely, on the resting surface 3 two or more cooker hobs could be applied alongside each other, each of which could be removable and replaceable.

Figures 12, 13, 14, 15:
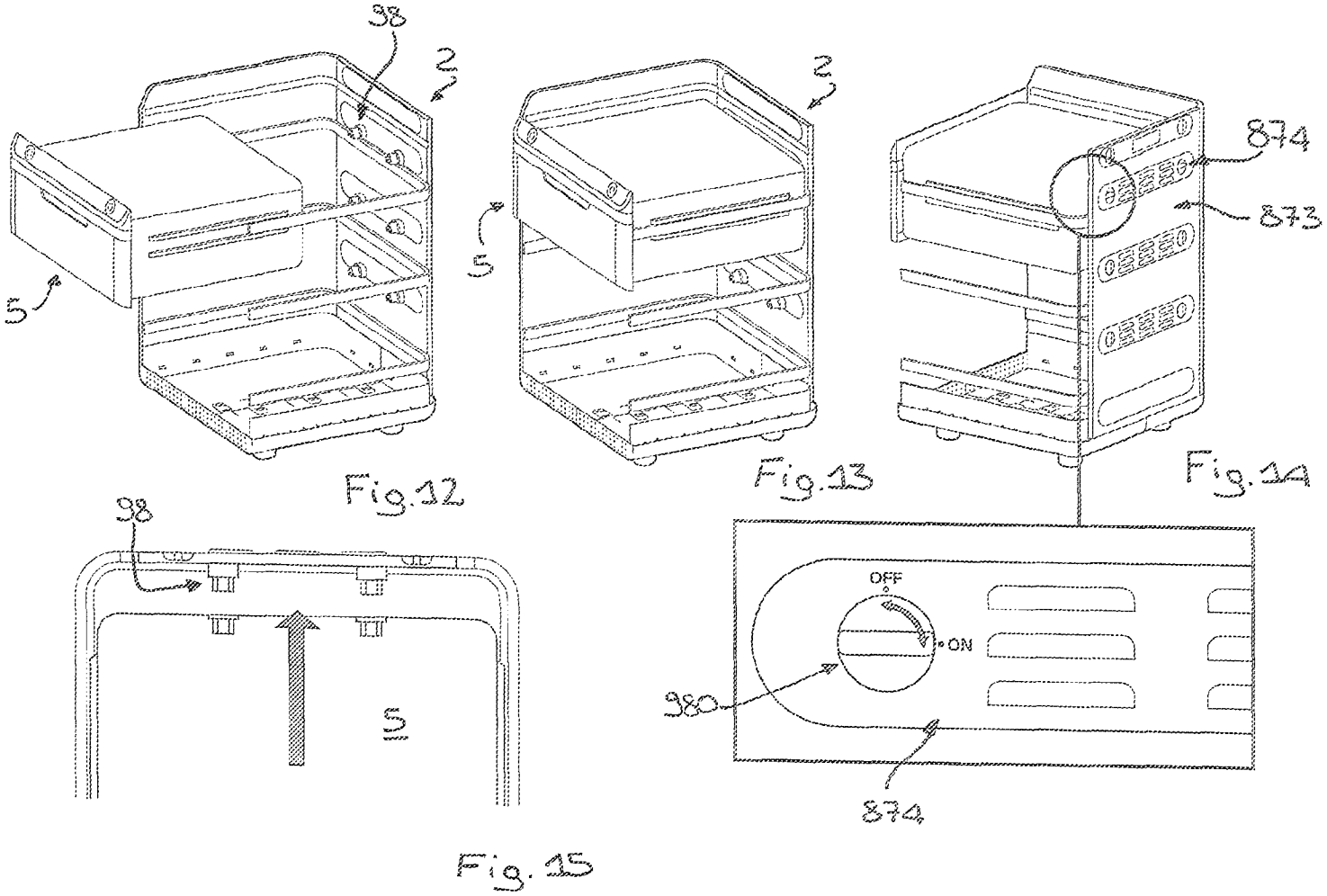
FIGS. 12, 13 show a cooker according to the present invention partially assembled and in different configurations.
FIG. 14 shows a different viewpoint to the one shown in FIG. 13.
FIG. 15 is a view from above of FIG. 12.

In an alternative embodiment, the first housing 20 could be positioned beneath the resting surface 3. In that case, the front wall 31 is defined at least partly by a door of said first functional module 5. Also in that case, the first functional module 5 could be a cooking module and, in particular, is an oven (but could also be a dishwasher or a refrigerator). See, for example, FIG. 12, 13 or 14.

Figure 20:
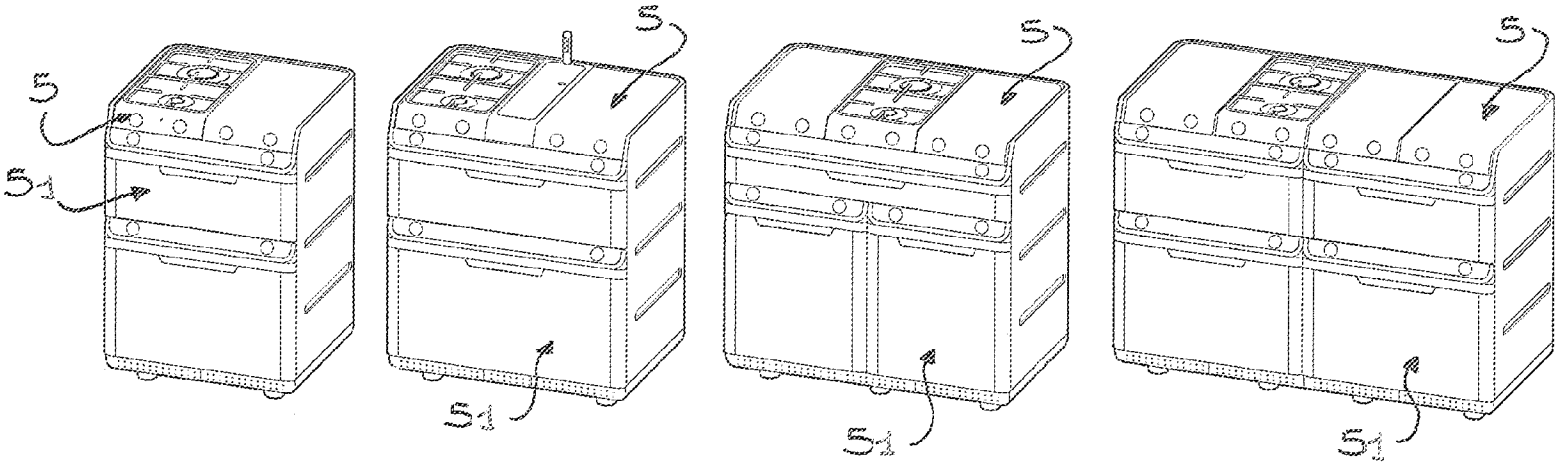
FIG. 20 shows different cookers according to the present invention.
Figure 21:
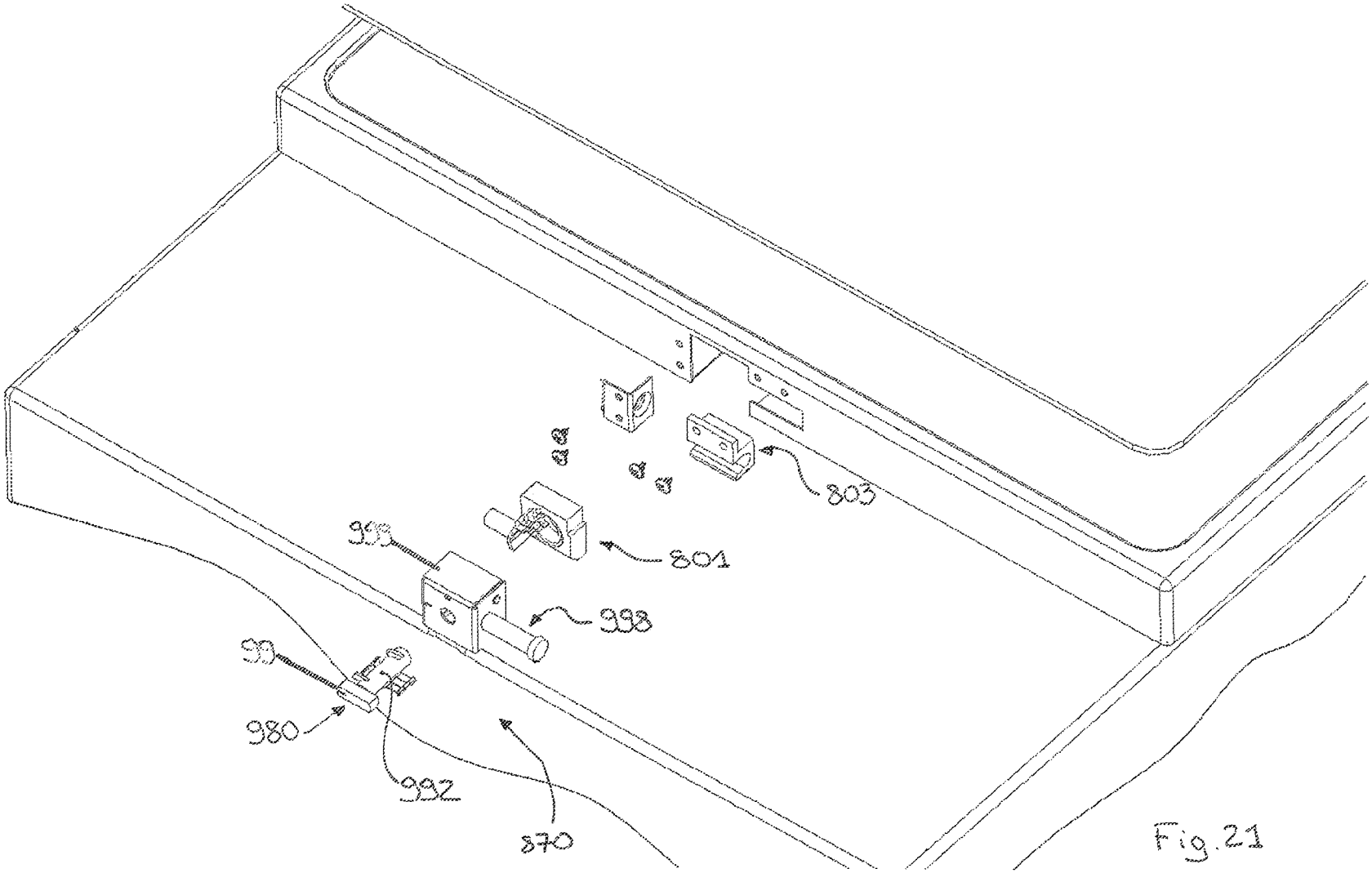
FIG. 21 shows a larger-scale view of the cooker according to the present invention.
Figure 24:
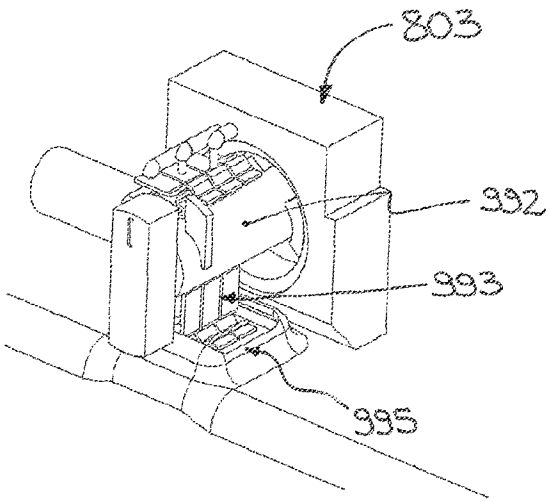
FIGS. 23 and 24 show a component of FIG. 21 in two different positions, said figures being shown considering an opposite viewpoint with respect to the one of FIG. 22.
Figure 23:
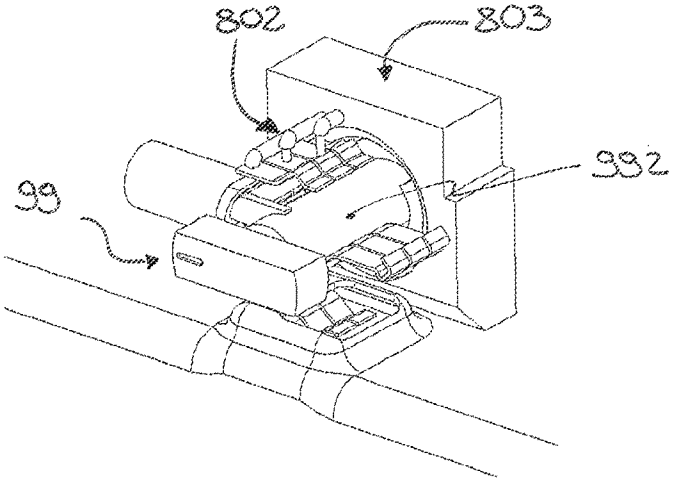
Figure 22:
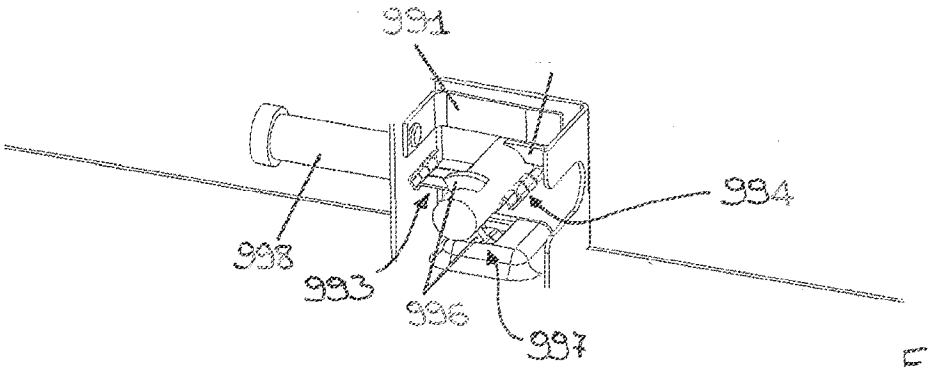
FIG. 22 shows a detail of FIG. 21.
Figure 25:
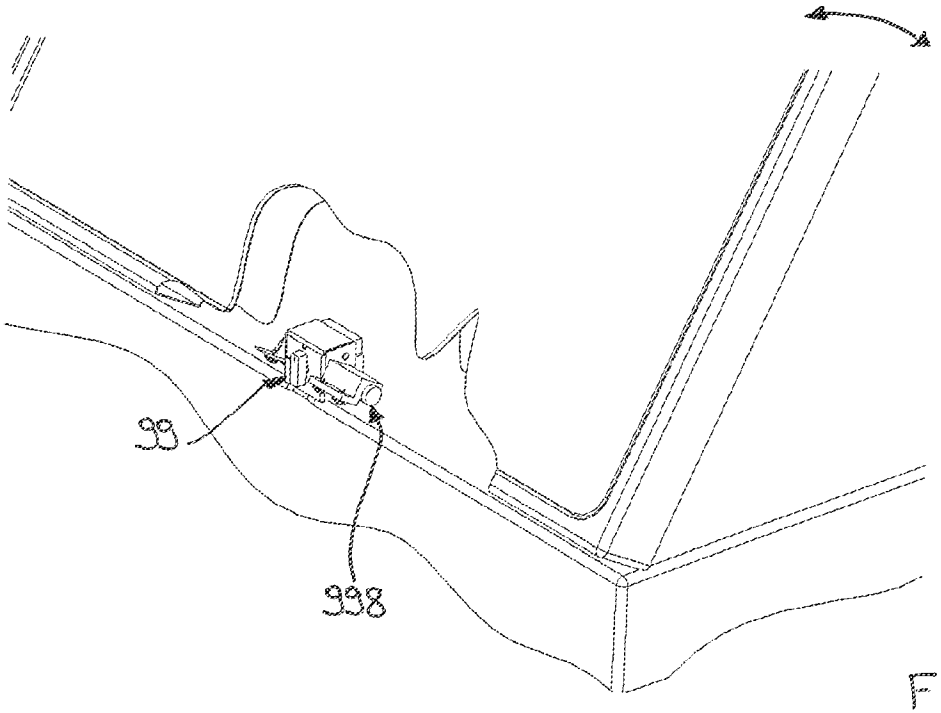
FIG. 25 shows a detail of FIG. 21 in an assembled configuration.

The freely installable cooker 1 could also comprise both the first cooking module 5 and a functional additional module 51 positioned beneath the resting surface 3. The functional additional module 51 is removable, interchangeable and housed in the support structure 2 (see FIG. 20). Said functional additional module 51 could be an oven or another household electrical appliance (for example, a dishwasher or a device for refrigerating food products). Opportunely, beneath the resting surface 3 a plurality of functional additional modules 51 could be present. Preferably, the functional additional modules 51 are different household electrical appliances. They could be alongside each other horizontally or stacked. For each functional additional module 51, what is described here could be repeated with reference to the first module 5.

Reference is now made to a possible embodiment wherein the first cooking module 5 is:

positionable on the resting surface 3;

mobile between a first and a second position. In the first position (see FIG. 7), the first cooking module 5 is substantially horizontal. In the second position (see FIG. 8), the first cooking module 5 is tilted upwards with respect to the first position. Opportunely, said tilting is by means of a first hinge 40. This assists cleaning of the resting surface 3.

The freely installable cooker 1 comprises electrical supply means 4 of the first cooking module 5. In the construction embodiment shown in FIGS. 6-10, the electrical supply means 4 comprise a first connector 41 rotatably, solidly joined to said first hinge 40. Also in the embodiment of FIGS. 6-10, the electrical supply means 4 comprise a second connector 42 solidly joined to the first cooking module 5. The first and second connectors 41, 42 may remain connected both in the first and in the second position. Advantageously, the freely installable cooker 1 comprises a switch of the electrical supply means 4. Said switch acts to prevent functioning of said first cooking module 5 when it is in the second position. The switch may be mechanically activated, for example by a mechanical abutment with which the switch comes into contact during passage from the first to the second position. Alternatively, the switch could be controlled gyroscopically.

Opportunely, the support structure 2 comprises a first and a second wall 871, 872. The support structure 2 further comprises a rear wall 870 interposed and connecting the first and the second wall 871, 872. The first and second wall 871, 872 are vertical. On the first and second wall 871, 872, there are respectively afforded at least a first and a second insertion and extraction guide 210, 220 of said first functional module 5. The first and second insertion and extraction guides 210, 220 allow removable connection of the first functional module 5 with respect to the support structure 2 (the first and the second insertion and extraction guides 210, 220 therefore form part of the guide and support means 91 of the first functional module 5). Opportunely, the first and second insertion and extraction guides 210, 220 extend horizontally.

The first insertion and extraction guide 210 comprises an inner channel 211 open at one end. The first functional module 5 comprises a protrusion 50 which, in a configuration of connection to the support structure 2, is inserted in said inner channel 211. Similar considerations may be repeated for the second insertion and extraction guide 220.

The object of the present invention is also a system comprising:

a freely installable cooker 1 having one or more of the characteristics described above;

a second cooking module, the first cooking module 5 being replaceable with the second module.

The first and second cooking modules could belong to a different type of cooking points (for example, one could be an induction cooker hob and the other a steam cooker hob).

Figure 3:
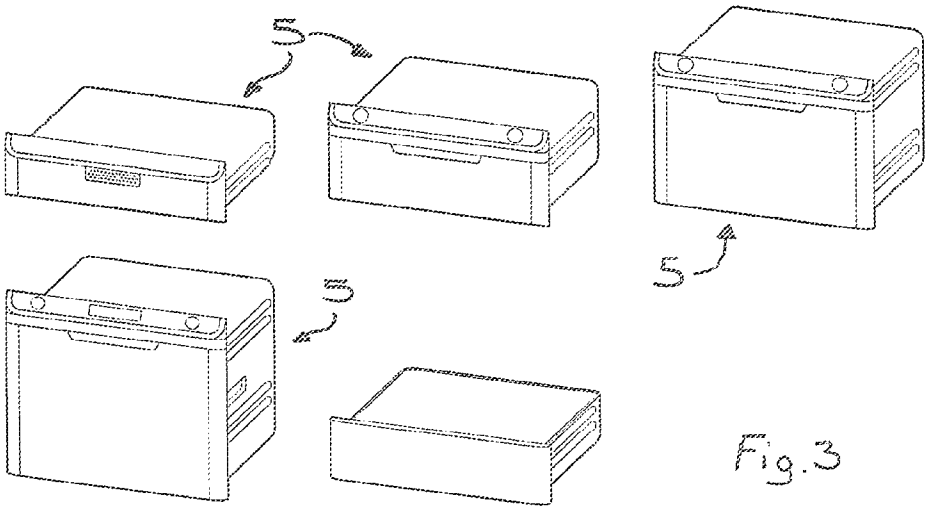
Figure 1:
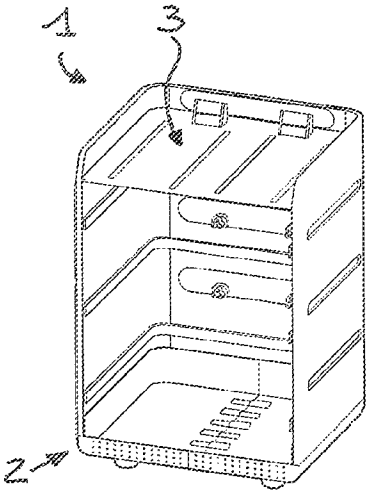
FIGS. 1 and 4 show a portion of the cooker according to the present invention.
Figure 5:
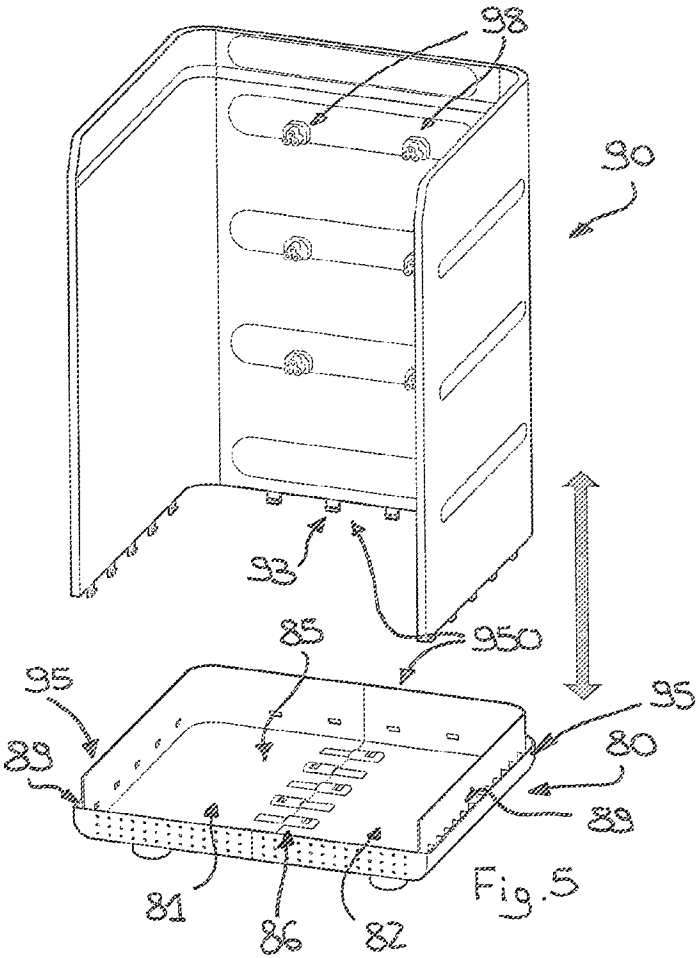
FIG. 5 is an exploded view of FIG. 4.
Figure 4:
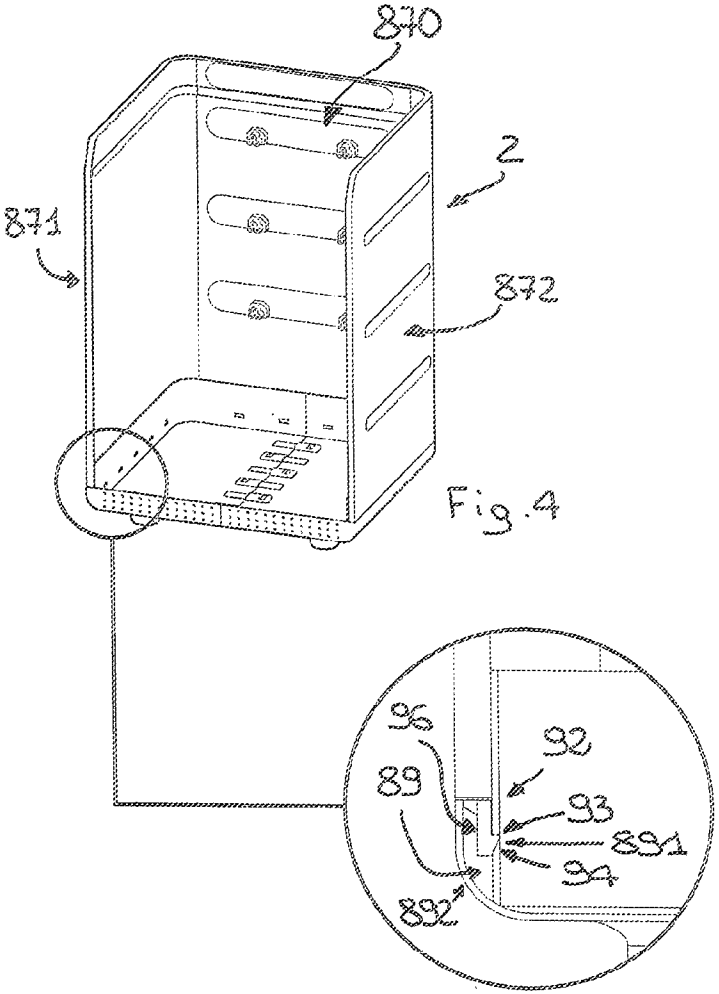

It could also be that the second model is an article washing module. In that case, the first functional module 5 (to be replaced) is opportunely, but not necessarily, an oven (and is positioned beneath the resting surface 3). An example of the cooking modules from which the first and second module could be chosen are shown in FIG. 2. Similar considerations may be repeated for the modules of FIG. 3.

An object of the present invention is also a method of realizing a freely installable cooker 1 comprising the steps of:

realizing a support structure 2 forming part of the freely installable cooker 1 and comprising the first housing 20;

choosing a predetermined first cooking module 5 from a group of separate, interchangeable cooking modules positionable in said first housing 20 and connectible to the support structure 2;

connecting said predetermined first cooking module 5 to said support structure 2.

Opportunely, the step of choosing the predetermined first cooking module 5 occurs typically during assembly. However, the method could provide, by the step of the final user, replacing said predetermined first cooking module 5 with another cooking module or more generally with another functional module.

As exemplified in the appended figures, the support structure 2 of the freely installable cooker 1 in turn comprises a base 80. The support structure 2 further comprises a containment structure 90 which extends between the top and the bottom, distancing itself from the base 80.

Figure 17:
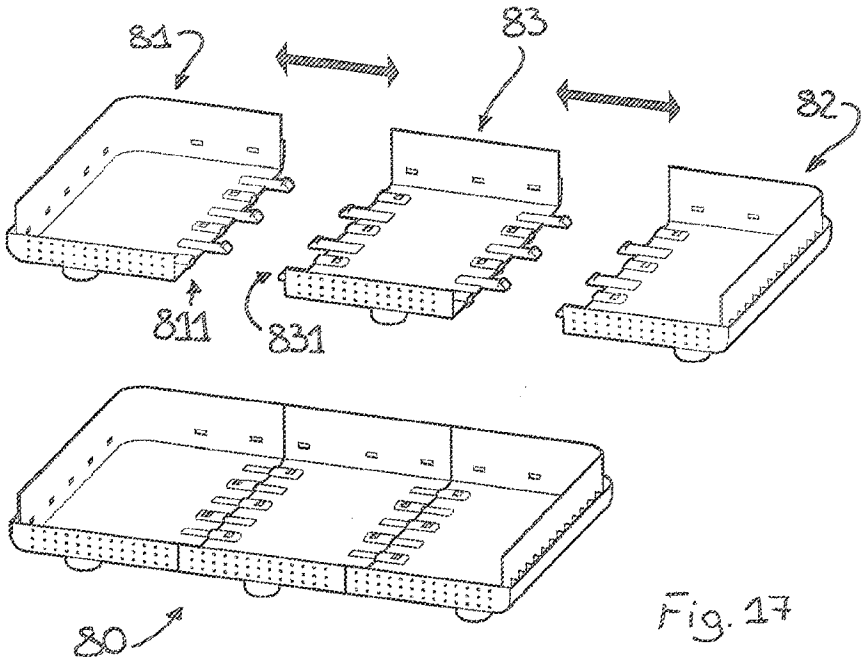
FIG. 17 shows a base (in an assembled configuration and in a partially larger-scale view) of the cooker according to the present invention.
Figure 16:
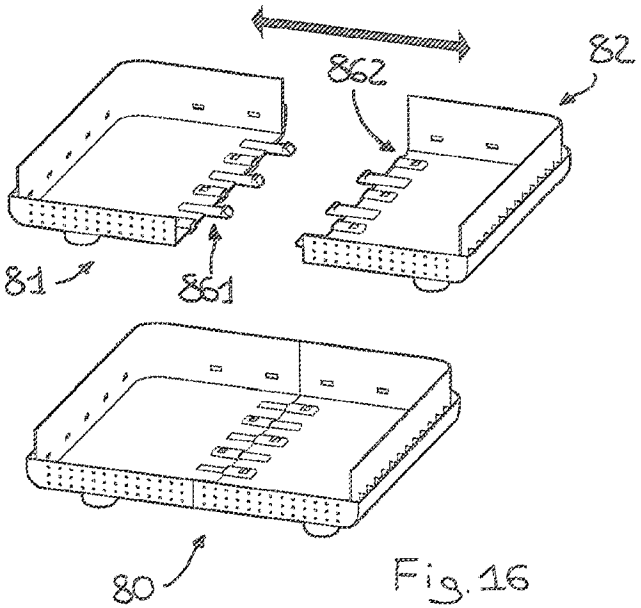
FIG. 16 shows a base (in an assembled configuration and in a partially larger-scale view) of the cooker according to the present invention.
Figure 19:
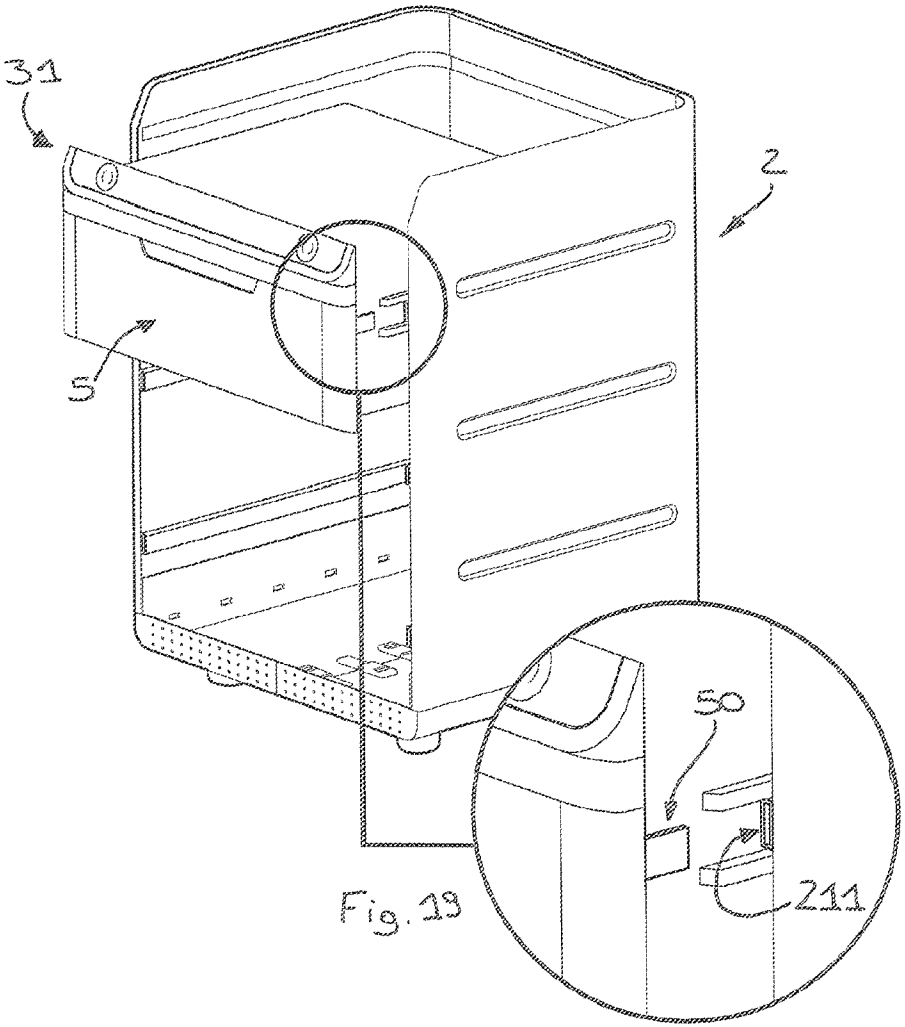
FIGS. 18 and 19 show a plan view and a perspective view of a cooker according to the present invention, partially assembled.
Figure 18:
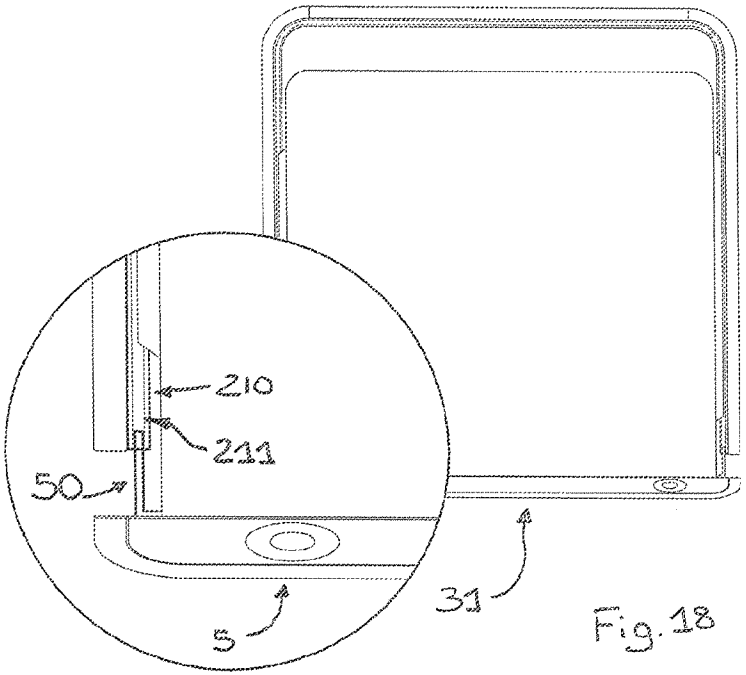

Preferably, the base 80 is an assembly of several panels. The panels are advantageously coplanar. The base 80 has a modular structure in order to reach the desired dimensions (see FIG. 16 or 17).

The modular structure of the base 80 comprises a plurality of panels in turn comprising:

a first panel 81;

a second panel 82.

The first and second panels 81, 82 contribute to defining a shared bottom surface 85.

Opportunely, said plurality of panels may comprise a third panel 83 interposed between the first and second panels 81, 82. The third panel 83 contributes to defining said shared bottom surface 85. In this way, the third panel 83 allows the base 80 to be elongated with respect to a situation in which only the first and the second panels 81, 82 are present.

For similar considerations, said plurality of panels may comprise a fourth panel adjacent to the third panel 83 and interposed between the first and the second panels 81, 82. The fourth panel contributes to defining the shared bottom surface 85.

The freely installable cooker 1 further comprises connection means 86 of two adjacent panels of the modular structure. The two adjacent panels may be chosen from said plurality of panels. The connection means 86 are afforded in a single piece with said two panels.

The connection means 86 of the two adjacent modules have a male-female type connection. Opportunely, the connection means 86 of the two adjacent modules comprise a plurality of inserts 861 which engage in corresponding housings 862. Opportunely, the inserts 861 engage in the housings 862 by means of elastic deformation. Advantageously, both adjacent modules alternate an insert and a housing forming part, respectively, of said plurality of inserts 861 and said plurality of housings 862.

The base 80 is quadrilateral. The third panel 83 of the support structure 2 comprises a first side 831 adjacent to a first edge 811 of the first panel; the connection means 86 are afforded at least along the first edge 811 and the first side 831.

In the preferred embodiment, the first panel 81 and/or the second panel 82 and/or the third panel 83 and/or the fourth panel are made of a plastic material. The freely installable cooker 1 could also comprise further panels. Preferably, all the panels of the base 80 extend in a row with one another along a straight line. Opportunely, the first panel 81 extends in a single piece. Opportunely, this could be repeated for the second panel 82 and/or the third panel 83 and/or the fourth panel.

Opportunely, the present invention further comprises a method of realization of a base 80 of a freely installable cooker 1. Opportunely, said freely installable cooker 1 has one or more of the characteristics described above. The method further comprises the step of connecting a plurality of modular elements of different shapes and dimensions in order to obtain a base 80 having pre-established dimensions.

With reference to the appended figures, the guide and support means 91 described above could be additional elements applied with attachment means to the remaining parts of the first and second walls 871, 872. In an alternative embodiment, the guide and support means 91 could be integrated into the first and into the second wall 871,872 (and in which case the guide and support means 91 would not be separable from the walls 871, 872). The first and the second wall 871, 872 could comprise a sandwich structure. In this case, the first and the second wall 871, 872 could comprise an outer covering 912, an inner covering 911 and interposed thermal isolation. In this case, the inner covering 911 defines the guide and support means 91. Typically, the inner and outer covering 911, 912 are made of a metal material.

Advantageously, the support structure 2 comprises connection means 92 of said base 80 and said containment structure 90. The connection means 92 comprise engagement means 93 and housing means 94 of said engagement means 93. The engagement means 93 and said housing means 94 are afforded where one is in said base 80 and the other is in said support structure 2. The connection between said engagement means 93 and said housing means 94 occurs at least at junction zones 95 of the first and the second walls 871, 872 with the base 80 and at a junction zone 950 of the rear wall 870 and said base 80.

Advantageously, the connection means 92 comprise elastic deformation means 96 attachable in said housing means 94. Typically, said connection means 92 comprise deformable tabs.

The freely installable cooker 1 comprises activation means 98 of functioning of said first functional module 5. They are advantageously afforded at said rear wall 870 (or in any case in a rear zone of the freely installable cooker 1). The activation means 98 may be activated manually in a first configuration, in which there is correct connection of said first functional module 5 and said containment structure 90 (or more generally of the support structure 2). In a particular embodiment, the activation means may comprise a selector 980. Said selector 980 only in said first configuration (i.e. when there is correct connection and positioning of the first functional module 5) allows the user to activate or not the functioning of the first functional module 5. Alternatively (non-preferred embodiment), said selector 980 could be activated directly by the correct connection of said first functional module 5 and said containment structure 90.

The activation means 98 assume a second configuration in which they prevent activation for functioning of the first functional module 5; opportunely, the passage from the second to the first configuration is determined by a mechanical thrusting action dictated by reaching of an end of stroke of the first functional module 5 (preferably along the guide and support means 91) and manual activation of said selector 980.

In said first configuration, the activation means 98 therefore come into contact with said first functional module 5. Opportunely, the first functional module 5 comprises an interface 801 destined to couple with said selector 980.

The activation means 98 therefore define a switch which, in the first configuration, is activated by the selector 980.

In the preferred embodiment shown in FIGS. 21-24, the activation means 98 (particularly the selector 980) comprise a knob 99. The selector 980 may assume a first position in which it prevents power supply of the first functional module 5. The selector 980 may assume a second position in which power supply of the first functional module 5 is permitted. The activation means 98 comprise a tab 991 which, in a blocking position, prevents rotation of the knob 99 from the first to the second position. The tab 991 may also assume an activation configuration in which it allows rotation of the selector 980 from the first to the second position. The second position of the selector 980 is assumed in said first configuration, i.e. when there is a correct connection and positioning of the first functional module 5. In fact, the first functional module 5 which has reached the end of stroke into said first configuration determines a movement of the tab 991 allowing rotation of the knob 99. The selector 980 comprises a stem 992 to which the knob 99 is solidly joined. The stem 992 in turn comprises at least a first and a second electrical contact 993, 994. Opportunely, the first and the second electrical contacts 993, 994 are elastic. In the second position of the selector 980, the first electrical contact 993 places in electrical communication said stem 992 and a power source 995 afforded on the support structure 2. In the second position of the selector 980 the second electrical contact 994 places in electrical communication said stem 992 and said first functional module 5.

Opportunely, the interface 801 of the first functional module 5 which interacts with the selector 980 comprises electrical wires 802 powered by said second electrical contact 994 and which allow power supply of the first functional module 5.

In this way, in the second position of the selector 980, electrical power supply of the first functional module 5 is permitted through the stem 992.

Advantageously, the stem 992 comprises an element (for example a fin 996) which, in the second position of the selector 980, interacts with a corresponding component 997 (which defines a housing 803) afforded in said first functional module 5 to prevent extraction of the first functional module 5. Opportunely, the freely installable cooker 1 comprises a pin 998 which engages in a counter-shaped housing 803 afforded on the first functional module 5. Opportunely, the pin 998 is solidly joined to a housing 999 of the selector 980. In said housing 999, said tab 991 is also advantageously housed. In this way, the first functional module 5 may rotate with respect to the support structure 2, which is solidly joined to the housing of the tab 991.

The rear wall 870 comprises:

a frame 873 which delimits an opening;

infill material 874 which closes the opening, said activation means 98 being applied to said infill material 874.

The base 80 comprises a groove 89 which surrounds the base 80 on three sides and in which are engaged the first wall 871, the second wall 872 and the rear wall 870.

The groove 89 extends at the junction zones 95 of the first and second walls 871, 872 with the base 80 and at the junction zone 950 of the rear wall 870 and said base 80. The groove 89 is defined at least by:

a first side 891 in which said housing means 94 are advantageously afforded;

a second side 892, the engagement means 93 being insertable between the first and the second sides 891, 892 (and coming into contact with the first and the second wall 871, 872).

The present invention has numerous advantages. In particular, it allows the realization of a plurality of basic components (the support structure and the functional modules) which may then be assembled in various ways to allow the desired customization of the freely installable cooker 1. In this way, it is possible to choose the desired arrangement of the electrical household appliances in a support structure (as well as to choose which type of electrical household appliances to insert in the support structure). The invention as conceived is susceptible to numerous modifications and variants, all falling within the scope of the inventive concept characterized thereby. Furthermore, all the details can be replaced by other technically equivalent elements. In practice, all the materials used, as well as the dimensions, can be of any type according to requirements.

The invention claimed is:

1. A method of creating a freely installable cooker comprising steps of:

providing a support structure forming part of the freely installable cooker and comprising a first housing and at least one first electrical connector rotatably and solidly joined with a first hinge, wherein the support structure forming part includes a plurality of base panels that cooperate to adjust a width of the support structure forming part and define an adjustable continuous interior volume within the first housing;

choosing a predetermined cooking module from a group of separate cooking modules, each predetermined cooking module being interchangeable, positionable in the first housing and connectible to the support structure forming part, the predetermined cooking module further comprising at least one second electrical connector, wherein the width of the adjustable continuous interior volume defined within the first housing is configured to be adjustable to conform to a selected predetermined cooking module;

connecting said predetermined cooking module and said support structure forming part; and connecting the at least one second electrical connector and the at least one first electrical connector, wherein the at least one first electrical connector is disposed within and extends through a rear wall of the support structure forming part.

2. The method according to claim 1, characterized in that the predetermined cooking module is replaced with another cooking module.

3. The method according to claim 1, characterized in that configuration of the adjustable continuous interior volume is defined at least partially by a number of base panels included within the plurality of base panels.

4. A freely installable cooker comprising:

a support structure comprising a first housing and at least one first electrical connector rotatably and solidly joined with a first hinge, the at least one first electrical connector attached to a rear wall of the support structure;

a first cooking module comprising at least one second electrical connector;

wherein the first cooking module is removable, interchangeable and positionable in the first housing of the support structure; and when the first cooking module is positioned in the first housing and the at least one second electrical connector is connected to the at least one first electrical connector, the first cooking module is rotatable about the first hinge, wherein the at least one first electrical connector includes a selector positioned on an exterior surface of a rear wall of the first housing, wherein the selector is positioned in lateral alignment with a respective first electrical connector of the at least one first electrical connector, wherein the at least one first electrical connector also includes an activation portion that is positioned opposite the selector on a front surface of the rear wall, the activation portion selectively receiving the at least one second electrical connector.

5. The freely installable cooker of claim 4, further comprising:

a resting surface accessible from above; and a front wall which develops between a top and a bottom, wherein the first housing is disposed on the resting surface and closed by the front wall.

6. The freely installable cooker of claim 4, wherein the first cooking module is:

positionable on an upper resting surface accessible from above;

movable between a first position and a second position;

wherein in the first position, the first cooking module is substantially horizontal;

wherein in the second position, the first cooking module is tilted upwards with respect to the first position by means of the first hinge so as to assist cleaning; and wherein the first cooking module includes an electric power supply means.

7. The freely installable cooker of claim 4, further comprising a resting surface;

wherein the first cooking module is a functional additional module positioned beneath the resting surface; and the functional additional module being removable, interchangeable and positionable in the first housing of the support structure.

8. The freely installable cooker of claim 4, further comprising an article washing second module, wherein the first cooking module is an oven; and the oven being replaceable with the article washing second module.

9. The freely installable cooker of claim 4, wherein the support structure includes a base that includes a plurality of base panels that cooperate to adjust a width of the support structure and define a continuous interior volume within the first housing of the support structure.

10. The freely installable cooker of claim 9, wherein the support structure includes a first vertical wall and a second vertical wall on which there are respectively disposed at least a first insertion and extraction guide and a second insertion and extraction guide of the first cooking module, the first insertion and extraction guide and the second insertion and extraction guide allowing removable connection of the first cooking module with respect to the support structure, and wherein a horizontal distance between the first and second insertion and extraction guides is determined by a number of base panels of the plurality of base panels that defines the width of the support structure.

11. The freely installable cooker of claim 10, wherein the first insertion and extraction guide includes an inner channel open at one end; and the first cooking module comprising a protrusion which, when connected to the support structure, is inserted into the inner channel.

* * * * *